United States Patent [19]

Wahl

[11] 4,121,378

[45] Oct. 24, 1978

[54] ANTI-BURGLAR WINDOW GUARD

[76] Inventor: Arthur A. Wahl, 6205 Broughton Rd., St. Charles, Mich. 48655

[21] Appl. No.: 817,813

[22] Filed: Jul. 21, 1977

[51] Int. Cl.[2] ..... E06B 3/68

[52] U.S. Cl. ..... 49/55; 49/61; 403/109

[58] Field of Search ..... 49/55, 50, 61, 56; 160/104; 403/104, 105, 109

[56] References Cited

U.S. PATENT DOCUMENTS

| | | | |
|---|---|---|---|
| 452,255 | 5/1891 | Bray | 403/109 |
| 1,641,523 | 9/1927 | Bell | 49/50 X |
| 1,745,661 | 2/1930 | Dittrich | 49/56 X |
| 2,753,762 | 7/1956 | Dorgelys | 403/109 X |
| 2,866,238 | 12/1958 | Lamb | 49/55 |

*Primary Examiner*—Philip C. Kannan

[57] ABSTRACT

An anti-burglar guard for a double hung window construction including a generally rectangular frame having upstanding side frame members mounting vertically staggered slidable sashes. The window guard includes a transversely extending elongate barrier and anchoring members, adjustably mounted on the barrier, for mounting the barrier on the side frame members adjacent one of the window sashes. The barrier mounts a stop which projects into the path of the other window sash to limit sliding movement thereof.

8 Claims, 8 Drawing Figures

ANTI-BURGLAR WINDOW GUARD

BACKGROUND OF THE INVENTION

This invention relates to a window guard for preventing unauthorized ingress through a window and more particularly to a window guard having a new and novel, adjustable mounting member for anchoring the guard to a window frame and for interrupting the path of travel of one of the window sashes after it has been opened a predetermined amount.

Unauthorized access to homes is frequently obtained by a burglar who breaks a glass pane mounted in a window sash. The burglar then slips his hand through the broken window to unlock the window sash, and then merely slides the window sash to an open position. To inhibit burglary, one could cover the entire outside of the window with expanded metal, but such a construction is not aesthetic. Moreover, a complete covering of the window with expanded metal seriously inhibits cleaning of the outsides of the window.

Not all windows are of the same dimensions and thus it is important that any such window guard be adjustable to accomodate such varying size windows. Accordingly, it is an object of the present invention to provide a window guard having new and novel extensible mounts for mounting the guard on the window frame.

It is another object of the present invention to provide a window guard for a window including an elongate barrier and sleeve type mounts, slidably receiving opposite ends of the barrier, including detent portions bearing against the barrier to inhibit such sliding movement.

It is another object of the present invention to provide a window guard having a transversely extending barrier, anchoring members adjustably mounted on opposite ends of the barrier for mounting the barrier outwardly of the outermost channel of a double channel window frame in which a window sash slides.

Still another object of the present invention is to provide the combination of a window having a double track frame mounting inner and outer window sashes and a window guard of the type described having a barrier mounted outwardly of the outer track and adjacent the sash which slides in the inner track, and including a transversely extending stop projecting inwardly into the path of an outer sash slidably movable on the outer track.

A still further object of the present invention is to provide a window guard of the type described including an anchoring member comprising a sleeve receiving a barrier rod and including a detent yieldingly bearing against the rod and engageable with a stop to prevent separation of the rod and the sleeve.

Other objects and advantages of the present invention will become apparent to those of ordinary skill in the art as the description thereof proceeds.

SUMMARY OF THE INVENTION

A window guard for a double hung window structure including a window frame slidably mounting at least one movable window sash, an elongate barrier, anchoring mechanism adjustably movable on opposite ends of the barrier for anchoring the guard to the window frame, and a transversely extending stop projecting into the path of the movable window sash.

The invention shall hereafter be more fully disclosed with reference to the accompanying drawings, in which.

DESCRIPTION OF THE PREFERRED EMBODIMENT

Figure 1:
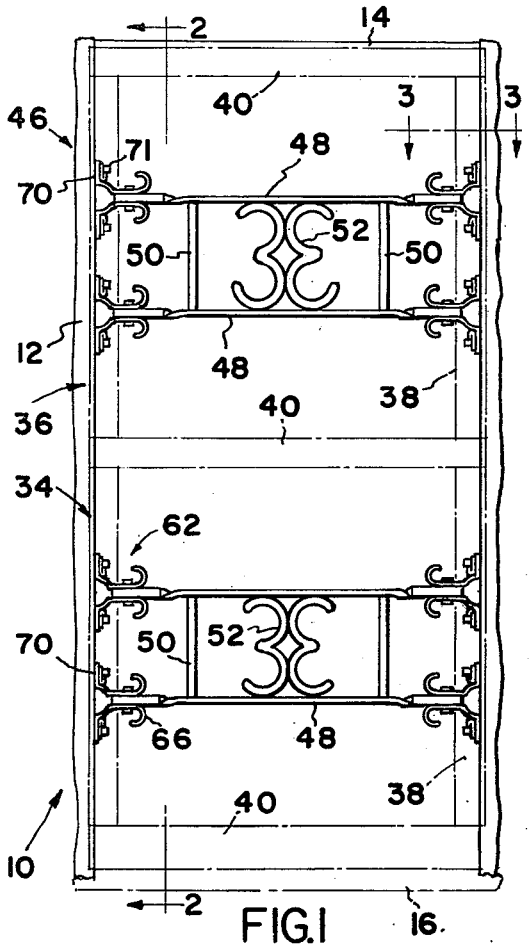
FIG. 1 is a front elevational view illustrating apparatus constructed according to the present invention.

A generally rectangular double hung window frame is generally designated 10 including vertical side frame members 12 spanned by upper and lower end frame members or headers 14 and 16. Each of the side frame members 12 includes inner, intermediate and outer, parallel vertical grooves or slots 16, 18 and 20 mounting generally vertical, blind stops or strips 22, 24 and 26 respectively. The blind stops 24 and 26 cooperate to define a vertical track or channel 30 extending between the upper and lower headers 14 and 16 respectively. Similarly, the blind stops 22 and 24 cooperate to define a vertical track or channel 32 extending between the upper and lower headers 14 and 16.

Figure 2:
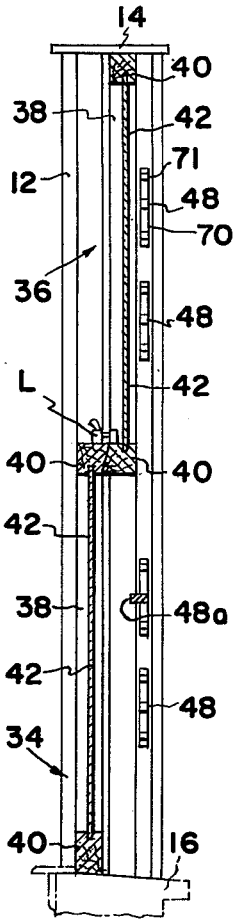
FIG. 2 is a sectional side view taken along the line 2—2 of FIG. 1.
Figure 3:
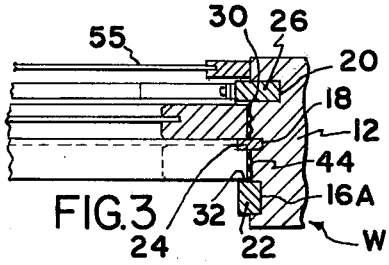
FIG. 3 is an enlarged sectional plan view taken along the line 3—3 of FIG. 1.

Slidably mounted in the inner and outer channels or tracks 30 and 32 are inner, lower and upper, outer sashes 34 and 36 respectively. Each of the sashes 34 and 36 include vertical side frame members 38 spanned by upper and lower frame members 40 mounting a glass pane 42, as usual. When the lower and upper sashes 34 and 36 are in their lowermost and uppermost closed positions, as illustrated in FIG. 1, the uppermost and lowermost end frame members 40 of the lower and upper sashes 34 and 36 are abutting as illustrated in FIG. 2. A conventional lock L is provided on the abutting window sash members to secure the sashes. Weather stripping, generally designated 44, is received in each of the channels or tracks 30 and 32 for inhibiting the passage of air between the inside and outside of the building wall W.

Apparatus constructed according to the present invention includes a window guard, generally designated 46, including upper and lower generally parallel bars or rods 48 spanned by linear vertical bars 50 and curvilinear bars 52 which form an aesthetic grid in the middle of the guard 46.

Each of the bars 48 is substantially rectangular in cross section but includes a twist or spiral section, generally designated 54, inwardly of each end thereof. The midsection 56 of the bar 48 has a height *h* which is substantially less than its breadth B and substantially less than the heighth H of the terminal ends 58. The twist section 54 disposes the end portions 58 of the bar at a 90° angle relative to the midsection 56 so that the height H of the end section 58 is substantially greater than the breadth *b* of the end section 58. The reduced breadth *b* enables the end section 58 to fit between the window sash 36 and a screen or storm sash 55. The twist or spiral sections 54 also increase the rigidity of the bar 54. The ends 58 includes a pair of upper and lower detent receiving slots 60 for a purpose to become immediately apparent.

Anchoring members, generally designated 62, are provided for anchoring the transversely extending bars 48 on the outermost blind stop 26. Each of the anchoring devices 62 includes a sleeve 64 receiving a terminal end 58 of a barrier bar 48. The sleeves 64 include ornamental, curvilinear upper and lower end portions 66 at one end thereof. The opposite end of the sleeve 64 terminates in mounting brackets 68 having generally vertical, linear mounts 70 which bear against the outermost blind stop 26. Tamperproof screws 71 are utilized to anchor the mounting brackets 68 to the outermost blind stop 26.

Figure 5:
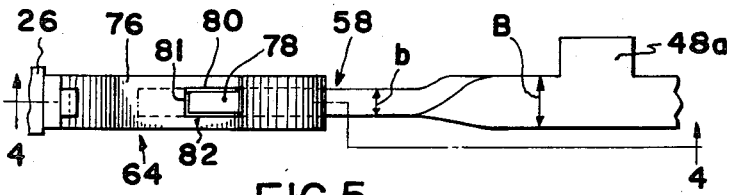
FIG. 5 is a top plan view of the apparatus illustrated in FIG. 4.

The sleeve 64, which is rectangular in cross section, includes upper and lower end walls 72 and 74 spanned by vertical side walls 76. The top wall 72 is cut along the lines 80, 81 and 82 (FIG. 5) and the resultant tab 78 is bent downwardly to form a detent received by the slot 60 along the upper side of the terminal bar end 58. The sleeve 64 is formed of spring steel and detent 78 will yieldingly bear against the bar sidewall 60*a* of the slot 60 to inhibit free sliding movement of the bar 58 while permitting restricted sliding movement thereof. The slot 60 includes an end wall 60*b* which will bear against the terminal end 78*a* of the detent 78 and prevent the escape of the sleeve 64 off the end of the terminal bar portion 58. The detent 78 will permit free sliding movement in the opposite direction. The cooperating detents 78 and slots 60 permit the anchoring sleeves 64 to be longitudinally adjusted along the slots 48 to accomodate windows of differing widths.

Figure 6:
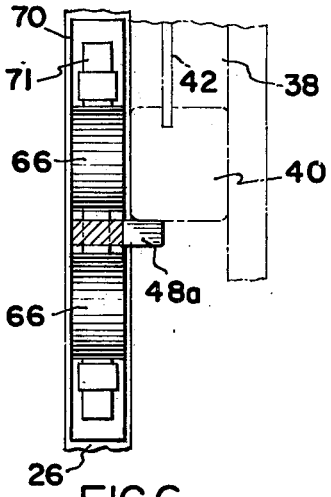
FIG. 6 is a sectional side view, taken along the line 6—6 of FIG. 4, particularly illustrating the stop on the barrier interrupting the travel of the window sash.

The window guards 46 are mounted in vertically spaced relation as illustrated in FIG. 1. The uppermost bar 48 of the lowermost window guard 46 will include a stop 48*a* on the bar midportion 56 which projects inwardly into the path of the uppermost sash 36 as illustrated in FIG. 6, to interrupt sliding movement thereof. If the lock L, which normally locks the upper and lower sashes 34, 36 together, is inadvertently unlocked and a burglar would attempt to move the uppermost sash 36 downwardly, the stop 48*a* will interrupt the downward movement of the window sash 36 beyond a predetermined distance as illustrated in FIG. 6. The sash window guards 46 permit the passage of air therethrough and yet provides an aesthetically pleasing barrier which permits viewing.

A storm sash or screen sash, generally designated 55, may suitably be mounted on the outer blind stop 26. If desired the upper window guard 46 could be eliminated and only the lower guard provided. The elimination of the upper window guard 46 would permit much easier ingress by a fireman who might have to break the glass to pass through the window. This arrangement would still provide protection in that the burglar could not enter through the lower sash 34. It is suggested that the glass 42, or at least the upper sash 36, be shatterproof. The guard 46 can also be used on a casement type window between the sash and screen.

ALTERNATE EMBODIMENT

Figure 7:
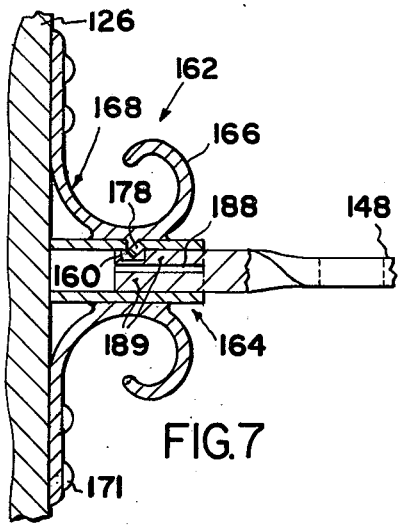
FIG. 7 is a sectional side fragmentary view, taken along the line 7—7 of FIG. 8, illustrating a slightly modified construction.
Figure 8:
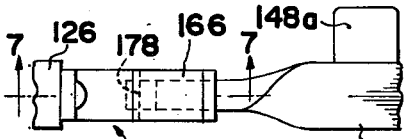
FIG. 8 is a top plan view of the apparatus illustrated in FIG. 7.
Figure 4:
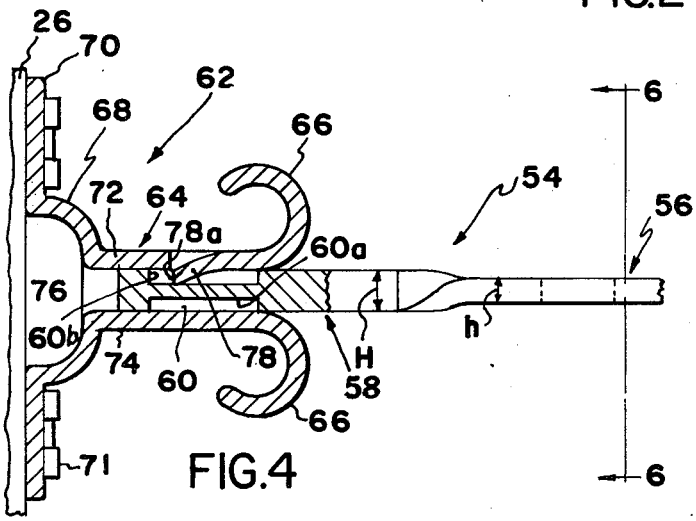
FIG. 4 is an enlarged, fragmentary sectional side view, taken along the line 4—4 of FIG. 5.

A slightly modified construction is illustrated in FIGS. 7 & 8 and generally similar parts will be designated by generally similar numerals prefixed by the numeral 1. The bar 148 differs from the bar 48 in that the bar 148 includes a relief slot 188 in the terminal end thereof to define a pair of bifurcated legs 189 which permits the member 168 and the bar 148 to be dismantled. The bifurcated legs 189 each include a slot or notch 160 which is substantially shorter than the notch or slot 60, for receiving a spring detent or tab 178 formed in the anchors 162. The notch 160 receives the spring detent 178 and precludes the anchoring member 162 from being inadvertently removed so far off the end of the bar 148 that the structure would be unsafe. As illustrated, the mounting brackets 168 have a slightly different aesthetic design than the mounting brackets 68.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. In combination with a window structure comprising a generally rectangular window frame having upstanding side frame members spanned by end frame members, said side frame members including inner and intermediate frame portions defining inner and outer generally parallel channels therein, a window sash receivable in each of said channels for sliding movement between vertically spaced positions, the improvement comprising:

a window guard including:

laterally extending barrier means;

mounting bracket means, adjustably movable on said barrier means, for mounting said barrier means;

anchoring means for anchoring said bracket means to said outer frame portion outwardly of said outer channel;

said barrier means including inwardly projecting stop means disposed in the path of said sash mounted on said outer channel to inhibit movement of said sash in said outer channel beyond a predetermined amount;

said barrier means comprising rod means;

said bracket means comprising sleeve means telescopically receiving said rod means;

said sleeve means including a spring detent and said rod means including an elongate recess receiving said detent.

2. A window guard for a window structure including a window frame slidably mounting at least one movable window sash, said guard comprising:

elongate barrier rod means;

means adjustably movably mounted on opposite ends of said barrier rod means for anchoring said guard to said window frame;

said anchoring means comprising sleeve means slidably receiving said rod means;

said sleeve means including detent means yieldingly bearing against said rod means but permitting relative sliding movement of said rod means and said sleeve means;

said rod means including stop means engageable by said detent means to prevent separation of said sleeve means and said rod means after said rod means and said sleeve means have relatively moved a predetermined amount;

said barrier rod means including open-ended, relief slot means in the terminal ends of said barrier rod means.

3. A window guard for a double-hung window structure including a rectangular frame having laterally spaced, vertical side frame members provided with a pair of inner and outer generally vertical channels therein, and a pair of inner and outer window sashes slidably received by said inner and outer channels for movement between upper and lower positions, said guard comprising transversely extending barrier means comprising transversely extending rod means;

anchoring means, adjustably mounted on the opposite ends of barrier means, for mounting said barrier means on said side frame members outwardly of said outer channel;

said transversely extending barrier means including stop means thereon projecting inwardly into the path of said outer sash for limiting the vertical movement of said outer sash;

each of said anchoring means comprising a sleeve member receiving an end of said rod means, said rod means including recess means and said sleeve member including cooperating detent means yieldingly received by said recess means and bearing against the side of said recess means for restricting movement of said sleeve member on said rod means in one direction but permitting relative sliding movement in the opposite direction.

4. The guard as set forth in claim 3 wherein said detent means comprises a spring steel detent member yieldingly bearing against said rod means.

5. A window guard for a window structure including a window frame slidably mounting at least one movable window sash, said guard comprising:

elongate barrier rod means;

means adjustably movably mounted on opposite ends of said barrier rod means for anchoring said guard to said window frame;

said anchoring means comprising sleeve means slidably receiving said rod means;

said sleeve means including detent means yieldably bearing against said rod means but permitting relative sliding movement of said rod means and said sleeve means;

said rod means including stop means engageable by said detent means to prevent separation of said sleeve means and said rod means after said rod means and said sleeve means have relatively moved a predetermined amount;

said rod means including slot means adjacent said stop means for receiving said detent means, the terminal end of said detent means extending inwardly to be received by said slot means.

6. The guard as set forth in claim 5 wherein said elongate barrier rod means includes transversely projecting stop means intermediate said anchoring means for interrupting the path of travel of said window sash.

7. The guard as set forth in claim 5 wherein said barrier rod means includes a pair of spiral sections on opposite ends of said stop means, the heighth and breadth of the portion of said barrier rod means between said spiral sections being substantially equal to the breadth and height respectively of the end portions of said barrier rod means.

8. The guard as set forth in claim 5 wherein said barrier rod means includes open-ended, relief slot means in the terminal ends of said barrier rod means.

* * * * *